US009801520B2

(12) United States Patent
Reyes

(10) Patent No.: US 9,801,520 B2
(45) Date of Patent: Oct. 31, 2017

(54) MOP HOLDER

(71) Applicant: Ruben Dario Reyes, Yonkers, NY (US)

(72) Inventor: Ruben Dario Reyes, Yonkers, NY (US)

( * ) Notice: Subject to any disclaimer, the term of this patent is extended or adjusted under 35 U.S.C. 154(b) by 0 days.

(21) Appl. No.: 14/920,027

(22) Filed: Oct. 22, 2015

(65) Prior Publication Data

US 2016/0135658 A1 May 19, 2016

(51) Int. Cl.
*A47L 13/51* (2006.01)
*A47L 13/512* (2006.01)

(52) U.S. Cl.
CPC ..... *A47L 13/512* (2013.01); *A47L 13/51* (2013.01)

(58) Field of Classification Search
CPC ..... A47L 13/50; A47L 13/512; A47L 13/51
USPC ..... 206/362.3, 349; 312/206
See application file for complete search history.

(56) References Cited

U.S. PATENT DOCUMENTS 1,008,856 A * 11/1911 Mosher ..... A45D 33/006 206/361
2,584,219 A 6/1946 Murrell
4,121,798 A * 10/1978 Schumacher ..... A47L 13/512 24/336
4,491,234 A * 1/1985 Wilcock ..... B44D 3/121 15/257.01
4,722,113 A * 2/1988 Olsson ..... A47L 13/58 15/143.1
4,799,744 A * 1/1989 Toy ..... A47L 19/04 211/184
4,995,526 A * 2/1991 Garrison ..... A47L 13/58 15/264
5,261,541 A * 11/1993 Li ..... A47G 25/12 211/62
5,813,567 A * 9/1998 Mangano ..... A47L 13/58 15/264
5,843,768 A * 12/1998 Lin ..... B65F 1/14 220/913
5,941,410 A * 8/1999 Mangano ..... A47L 13/51 15/264
5,974,621 A * 11/1999 Wilen ..... A47L 13/59 15/260
5,984,090 A * 11/1999 Banfield ..... G10D 3/00 15/160
6,012,198 A * 1/2000 Thole ..... B05C 17/0245 15/257.01
6,115,877 A * 9/2000 Morad ..... A47L 13/59 15/260
6,264,147 B1 * 7/2001 Mitchell ..... A47L 13/512 211/66
6,513,889 B1 * 2/2003 Park ..... A47L 13/51 312/206

(Continued)

*Primary Examiner* — Michael Jennings
(74) *Attorney, Agent, or Firm* — Myron Greenspan Lackenbach Siegel LLP

(57) ABSTRACT

This unit is created to put the mop away and help it dry when is wet. It has three separate pieces. The main unit, which is in the form of a tall rectangular box, contains four equal sides with spaces for ventilation so that the humidity doesn't get trapped in, and a base that will be used to support the unit. The second piece is a snap on piece that will connect with the main unit that helps hold the mop up and be able to stand vertically firm. The third piece is a small drawer where the water will drip from the mop when wet and be emptied out.

7 Claims, 6 Drawing Sheets

(56) References Cited

U.S. PATENT DOCUMENTS

| | | | | |
|---|---|---|---|---|
| 7,318,247 | B2 * | 1/2008 | Libman | A47L 13/58 15/260 |
| 8,025,347 | B1 * | 9/2011 | Solis | A47L 13/20 312/206 |
| 8,042,215 | B2 * | 10/2011 | Thibault | A47L 13/58 15/142 |
| 8,652,263 | B2 * | 2/2014 | Goentzel | A47L 13/59 134/6 |
| 8,871,029 | B1 * | 10/2014 | Leslie | A47L 23/04 134/6 |
| 2002/0092106 | A1 * | 7/2002 | Fu | B43L 21/04 15/142 |
| 2005/0061695 | A1 * | 3/2005 | Nogin | A47L 13/51 206/362.3 |
| 2005/0103955 | A1 | 5/2005 | Billman | |
| 2005/0252921 | A1 * | 11/2005 | Van Landingham | A47L 13/51 220/608 |
| 2015/0190030 | A1 * | 7/2015 | Johnson | A47L 13/59 15/261 |
| 2015/0210429 | A1 * | 7/2015 | Bensussan | A47L 13/50 220/532 |

* cited by examiner

Fig. 2a
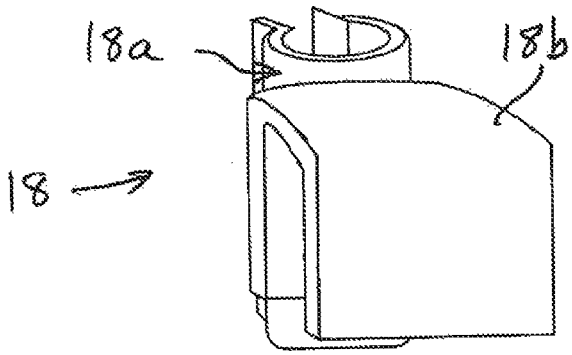
Fig. 2b
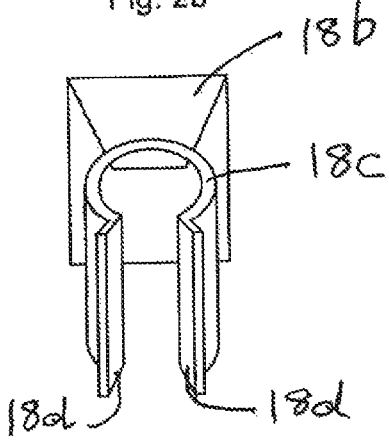
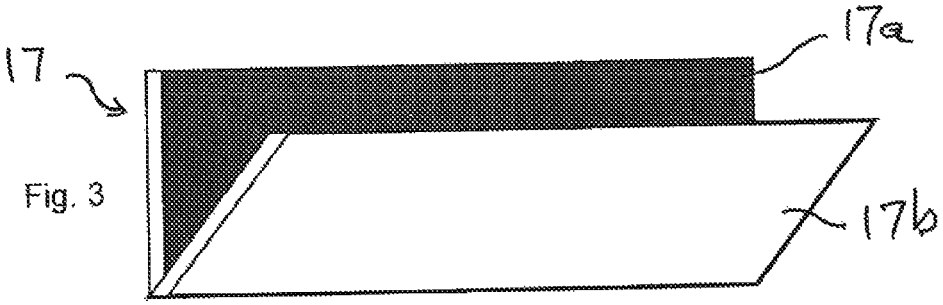
Fig. 3
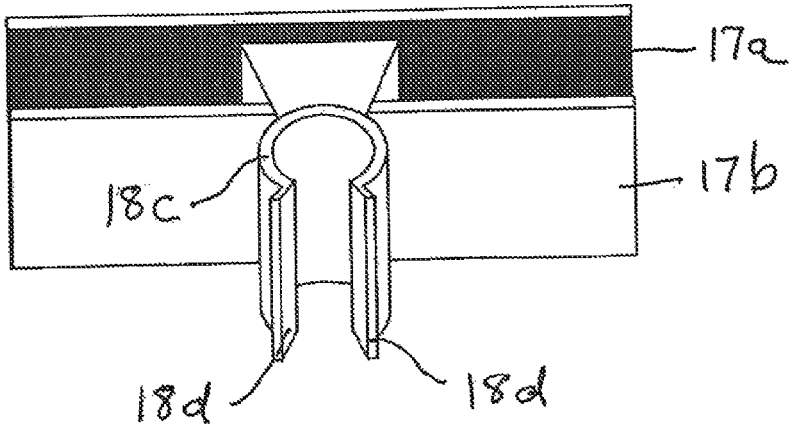
Fig. 4

MOP HOLDER

BRIEF DESCRIPTION OF THE DRAWINGS

Those skilled in the art will appreciate the improvements and advantages that derive from the present invention upon reading the following detailed description, claims, and drawings, in which:

FIG. 2*a* shows the back side of the hook used to place the mop inside the main unit;

FIG. 2*b* shows the front side of the hook where the mop pole will be placed and snap on with pressure to remain sturdy and for easy use;

FIG. 3 shows the fixed piece that comes within the main unit to hold the hook;

FIG. 4 shows the fixed piece from FIG. 3 with the hook piece from FIGS. 2*a* and 2*b* when they are mated together;

FIG. 5 shows the bottom piece or drawer that will hold any water if the mop is dripping, one can easily remove it from the main unit to empty it out and put it back in;

FIG. 7 shows a final result of how the mop will be and how the drawer is place at the bottom and can slide open to remove any water and can slide back in.

DETAILED DESCRIPTION

Figure 1:
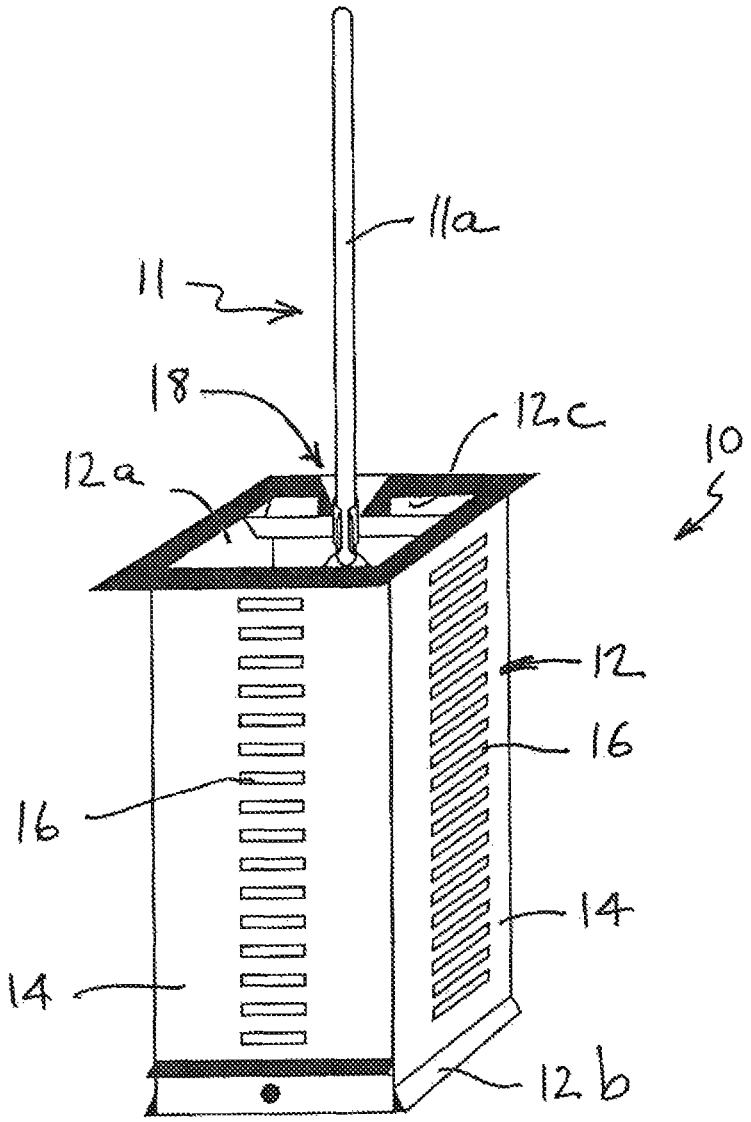
FIG. 1 shows the complete body of the Mop Holder with all its pieces and illustrates how it is used.

Referring now specifically to the Figures, in which the similar or identical parts have been designated by the same reference numerals throughout, and first referring to FIG. 1, a mop holder in accordance with the present invention is generally designated by the reference numeral 10.

The mop holder 10 is intended to hold a mop 11 and the mop stick or handle 11*a* in a generally vertical orientation to allow the mop head 11*b* (FIG. 6) to drip water from the mop into the mop holder.

The mop holder 10 includes a generally vertical or main unit 12 with an interior space 12*a* having a base 12*b*. The vertical unit 12 has an open upper end 12*c*. The vertical unit 12 has a generally vertical axis and is elongated along that axis as shown in FIG. 1. The specific configuration of the vertical unit is not critical and is shown in the form of a rectangular box. The rectangular box may have four equal sides 14 as shown and the specific dimensions of the box are not critical as long as a mop head can be inserted as shown and described. The vertical unit or box is preferably provided with openings 16 in the sides 14. The spaces or openings 16 are shown in the preferred embodiment as being in the form of a series of generally parallel horizontal slots in each of the sides 14. The specific shapes of the slots is not critical nor must they be provided on all of the sides 14. These are provided to enhance air circulation through the interior space of the unit to speed or quicken the drying of the mop head while and after liquid has dripped from the mop head but may still be moist.

Referring to FIGS. 2*a* and 2*b*, the connecting member 18 is illustrated in the form of a snap-on piece that includes a resilient clip retainer 18*a* and an inverted U-shaped support 18*b*. The resilient retainer or clip 18*a* includes a cylindrical portion 18*c* with a longitudinal opening as shown and outwardly flaring tabs or guide members 18*d*. The resilient clip or retainer 18*a* is adapted for releasably snapping onto a mop pole, stick or handle. Cylindrical portion 18*c* is dimensioned to receive a mop pole or stick in pressure relationship and the longitudinal opening allows the mop pole or stick to be inserted within by snapping into the clip retainer. The outwardly flaring vertical tabs are provided for guiding and facilitating insertion of a mop pole or stick within the clip retainer.

The snap-on piece 18 includes an inverted generally U-shaped member 18*b* having a downwardly facing interior surface that forms a first engaging member or surface.

Referring to FIGS. 3 and 4, a generally V-shaped tray or support plate 17 serves as a support within the unit 12 at the upper vertical region thereof. The tray 17 includes a first generally flat portion 17*a* attachable by any suitable means to the unit 12 over the interior space 12*a* of the main unit 12 in the region of the upper opening 12*c*. A angularly offset portion 17*b* projects inwardly or away from the side 14 on which the V-shaped tray is mounted to provide a mating support surface for releasably supporting the U-shaped support 18*b*. The U-shaped support 18*b* and offset portion 17*b* can selectively and releasably engage to support the connecting member 18 when a head of a mop is placed within the vertical unit.

Figure 5:
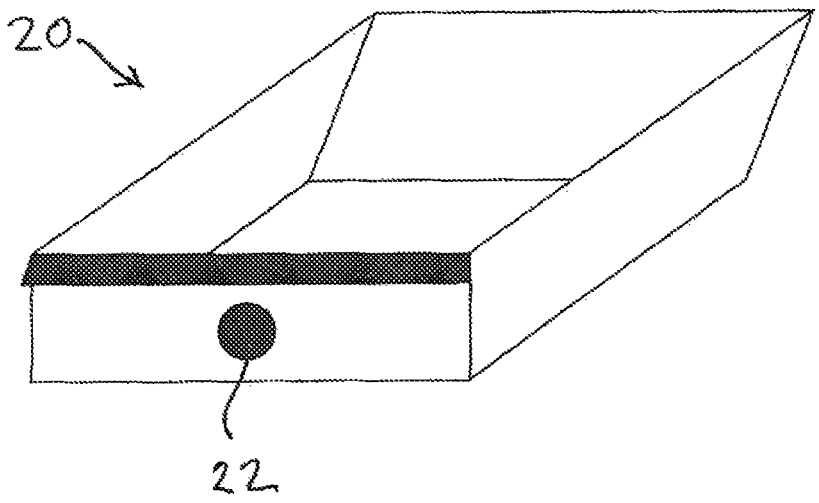
Figure 7:
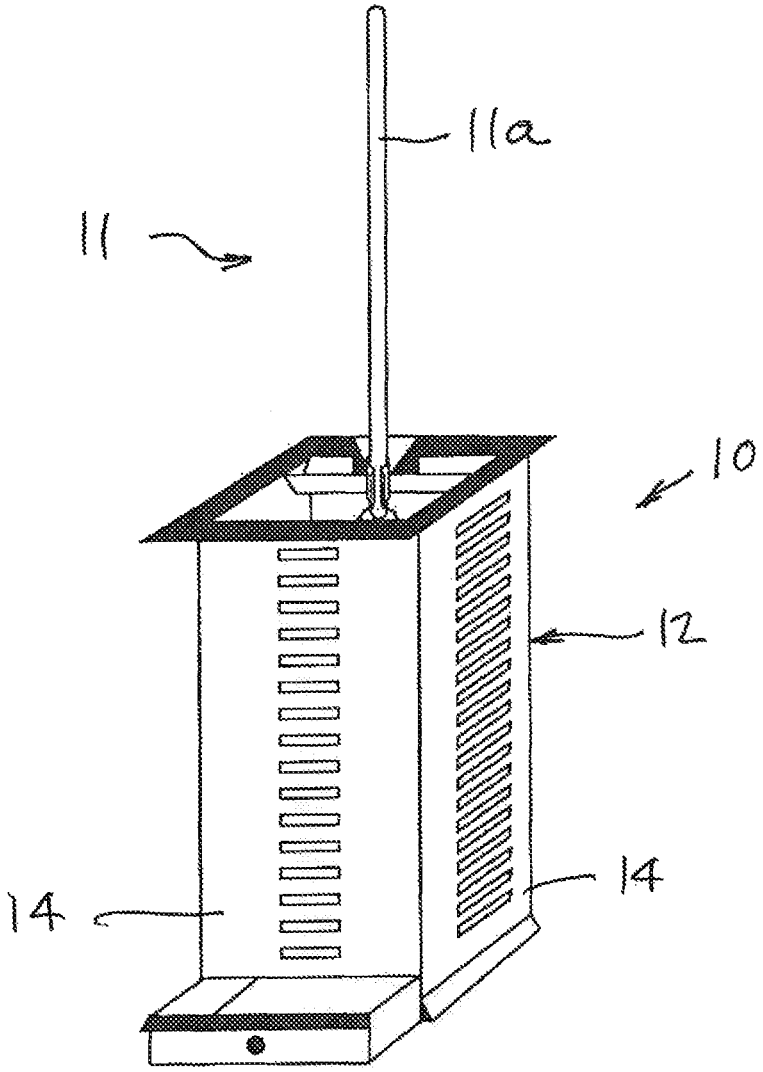
Figure 8:
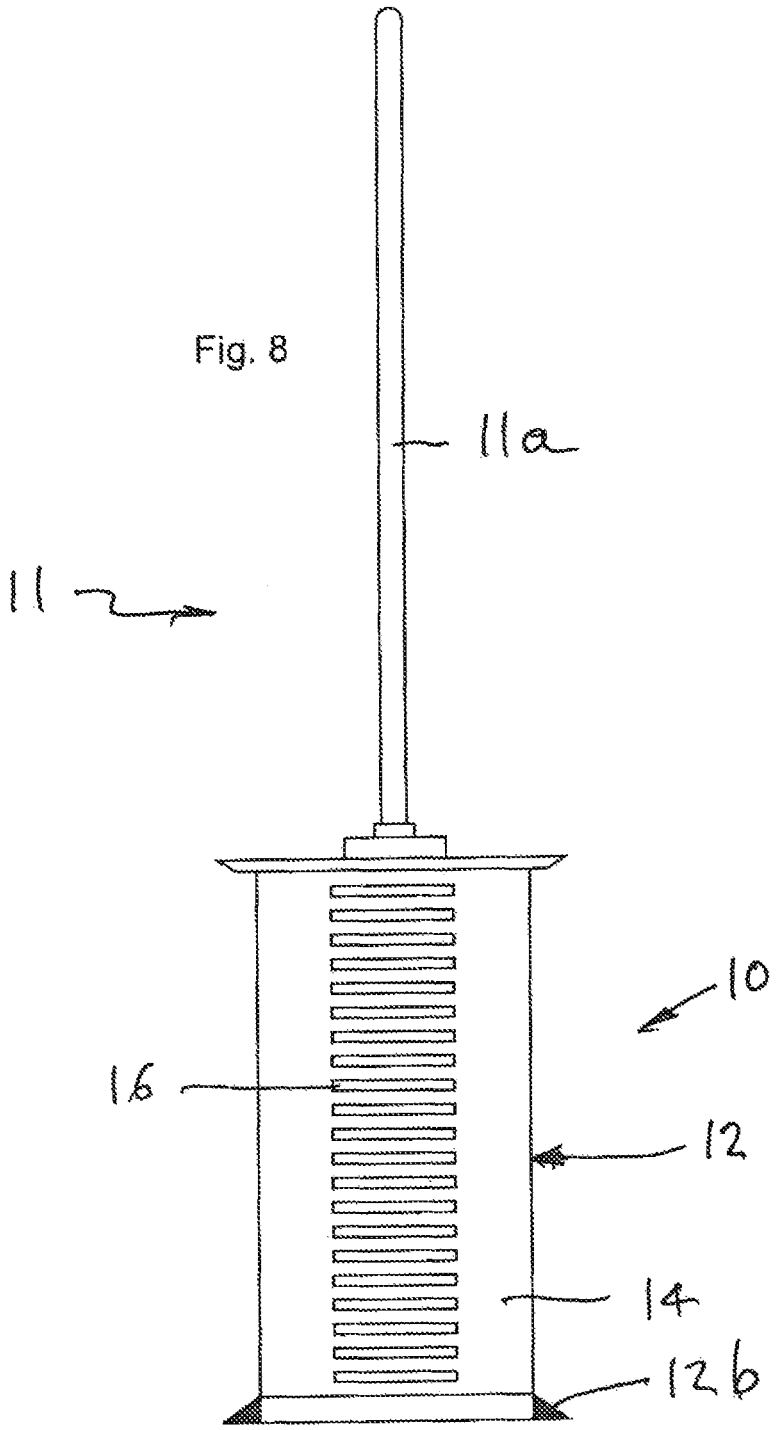
FIG. 8 shows the back side of the main unit with a mop placed inside the body.

Referring to FIGS. 5 and 7, a receptacle is preferably provided above the base 12*b* for collecting fluid that drips off a wet mop head placed within the unit.

Figure 6:
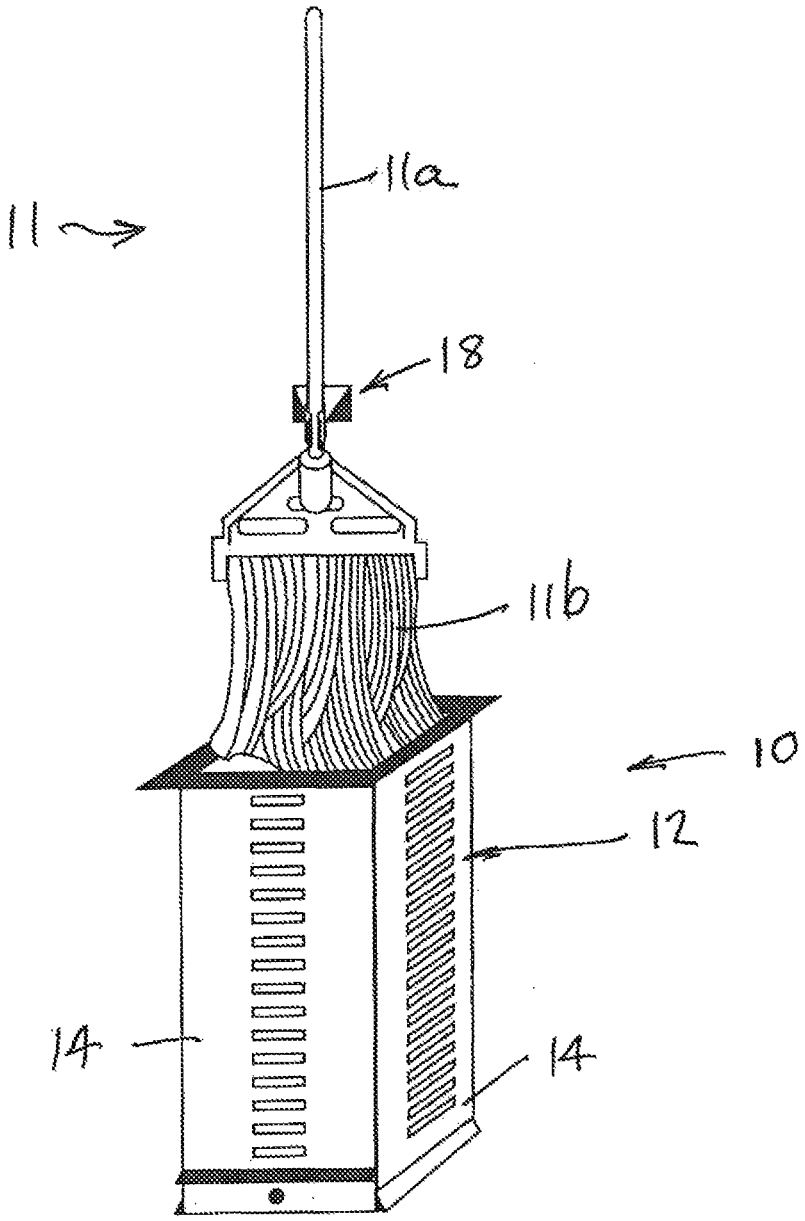
FIG. 6 shows a demonstration with the mop snapped in the hook piece and how it can be placed into the main unit or can be pulled out.

In use, the snap on piece or clip 18 is secured to the lower end of the mop stick or handle 11*a* proximate to the mop head as shown in FIGS. 1 and 6. The wet mop head can then be inserted into the enclosure of the vertical unit as shown in FIG. 1 and the water or other liquid is then allowed to drip off and drain onto the base or, preferably within the drawer or tray 20 as shown in FIG. 5. While the mop is draining the stick or handle 11*a* projects upwardly and may be gripped at any time to remove the mop from the unit so that the mop can be used. After it has been used it may be replaced onto the V-shaped tray or support plate 17, as suggested in FIG. 4. Once all the fluid has drained from the mop head the drawer or tray 20 may be removed, as suggested in FIG. 7, and any collected fluid discarded.

In use, a person would simply grasp the mop handle and then slide the end of the mop into the space incorporated into the top of the "Mop Holder". This specially designed holder would allow the mop to stand vertically to help the mop dry. It is easy to snap on. It would provide consumers with a safe, compact, easy-to-access, and aesthetically-appealing means of storing and drying a mop. (a) The "Mop Holder" could be produced from plastic or wood, as well as other various materials. (b) It could also be produced in a variety of colors and easily use conventional and readily available materials and manufacturing processes. No new production technology would be required. It could be produced from a plastic such as polystyrene. This material, which is readily available in color, is reasonably priced and easily formed by a wide range of plastic processors. Injection molding might be viewed as a standard approach to production. (c) Alternatively, the "Mop Holder" could be produced from wood, oak, poplar using conventional manufacturing processes. Currently, many manufacturers use Computer Numerical Controlled saws, shapers, routers, lathes, drills, etc., to produce consistent wood shapes and parts. A manufacturer may use conveyers and other material handling machinery to lift, position, or feed the stock into the woodworking equipment as well as to handle the outfeed. Production worker will control the operation of any equipment and would complete any other aspects of the fabrication process manually. (d) The "Mop Holder" could be packaged in a cardboard pressboard box, sized to the product. The box could be imprinted in one or more colors. A small pamphlet could be included in each package detailing instructions for assembly or installation. Corrugated cardboard shipping containers would be used to hold a quantity of individually packaged products to facilitate shipment and storage.

The invention claimed is:

1. A mop holder for storing a mop when not in use comprising a mop having a pole and a mophead including a tailband supported at one end of the pole and formed of strands of a predetermined length and having free ends remote from said pole; a vertical unit having an interior space and a base for supporting said vertical unit and an open upper end a predetermined height above said base, said predetermined height being greater than said predetermined length of said strands; a drawer above said base for collecting fluid that drips off a wet mop head; first engaging member securely fixed to the pole in proximity of said tailband; a mating second engaging member connected to said open upper end of said vertical unit, wherein the mating second engaging member is v-shaped tray that releasable engages said first engaging member, said first engaging member being positioned on said pole so that when said first and second engaging members are engaged the mop is secured in a generally vertical position with the mop pole projecting above said vertical unit and said free ends of said tailband strands are positioned above said drawer to allow any moisture in the mop to drip off and drain into said drawer while allowing removal of the mop for mopping by lifting said mop and separating said engaging members, said drawer being slidably receivable within said vertical unit for collection of fluid that drips off the mop head strands and removable from said vertical unit to dispose of any collected fluid, whereby a wet mop can be placed into said mop holder with a predictable and repeatable spacing between said free ends of said strands of the mophead and said drawer to insure efficient and effective dripping and removal of fluid from and drying of said tailband.

2. A mop holder as defined in claim 1, wherein said vertical unit is a rectangular box.

3. A mop holder as defined in claim 2, wherein said rectangular box has four equal sides.

4. A mop holder as defined in claim 1, wherein said first engaging member includes an inverted generally U-shaped member having an interior surface that forms said first engaging member.

5. A mop holder as defined in claim 1, wherein a generally V-shaped tray includes means for connecting said tray to said vertical unit, said mating second engaging member positioned to mate with and support said first engaging member when a mop is placed within the vertical unit.

6. A mop holder as defined in claim 1, wherein said vertical unit is provided with ventilation means for enhancing air flow and ventilation therein.

7. A mop holder as defined in claim 6, wherein said ventilation means comprises a plurality of slots in said vertical unit.

* * * * *